US006854664B2

(12) United States Patent
Smith

(10) Patent No.: US 6,854,664 B2
(45) Date of Patent: Feb. 15, 2005

(54) SELF-CAMMING SNAP RING FOR POP-UP SPRINKLER WITH TOP SERVICEABLE DIAPHRAGM VALVE MODULE

(75) Inventor: Phillip E. Smith, Escondido, CA (US)

(73) Assignee: Hunter Industries, Inc., San Marcos, CA (US)

( * ) Notice: Subject to any disclaimer, the term of this patent is extended or adjusted under 35 U.S.C. 154(b) by 228 days.

(21) Appl. No.: 10/238,368

(22) Filed: Sep. 9, 2002

(65) Prior Publication Data

US 2004/0046046 A1 Mar. 11, 2004

(51) Int. Cl.[7] ..... B05B 15/10

(52) U.S. Cl. ..... 239/205; 239/206; 239/600; 248/229.16; 248/229.26

(58) Field of Search ..... 239/203, 204, 239/205, 206, 600; 248/229.16, 229.26

(56) References Cited

U.S. PATENT DOCUMENTS 4,084,727 A * 4/1978 Albers ..... 221/298
4,097,171 A * 6/1978 Fier ..... 404/26
4,609,822 A * 9/1986 Roche ..... 250/352
6,491,235 B1 * 12/2002 Scott et al. ..... 239/206

* cited by examiner

*Primary Examiner*—Christopher Kim
(74) *Attorney, Agent, or Firm*—Michael H. Jester

(57) ABSTRACT

A diaphragm valve module is mounted in the lower end of the outer housing of a pop-up rotor type sprinkler for controlling the flow of water through an inlet in response to actuation of a valve actuator component. A resilient deformable semi-circular snap ring is mounted on top of the module and has a pair of opposing peripheral annular portions. Upon removal of the sprinkler riser, the snap ring can be disengaged from an annular groove formed in the interior wall of the outer housing by manually squeezing the annular portions together. This permits removal of the module for repair or replacement. The annular portions of the snap ring are formed with angled slots that receive projections that extend from the cover of the module to produce a camming movement that uniformly retracts the snap ring out of the annular groove to more readily permit removal of the module.

11 Claims, 12 Drawing Sheets

SELF-CAMMING SNAP RING FOR POP-UP SPRINKLER WITH TOP SERVICEABLE DIAPHRAGM VALVE MODULE

CROSS-REFERENCE TO RELATED APPLICATION

This application is related to U.S. patent application Ser. No. 09/659,977 filed Sep. 12, 2000 of Loren W. Scott and Phillip A. Hope, the entire disclosure of which is hereby incorporated by reference.

BACKGROUND OF THE INVENTION

The present invention relates to sprinklers used to irrigate lawns, playing fields, golf courses and the like, and more particularly, to an irrigation sprinkler that can be serviced from the top of the sprinkler without having to excavate the same.

Sprinklers have long been used to water turf and other vegetation. Many designs have been developed with the goal of uniformly distributing a desired precipitation rate over a given area. One of the most common type of sprinklers is the pop-up type that is normally mounted in a sub-surface location so that the top of the sprinkler is substantially at ground level. When water pressure is applied, a riser with a nozzle at its upper end extends and delivers a spray of water over the adjacent area. When the water pressure is terminated, a spring retracts the riser so that the upper end of the nozzle is flush with the head of the sprinkler. This removes the sprinkler as an obstacle to play occurring on the turf and allows the turf to be mowed.

So-called rotor type pop-up sprinklers having internal water turbines for rotating their nozzles have been developed and widely commercialized. Furthermore, pop-up sprinklers with diaphragm type valves incorporated into the same are widely utilized. A common type of pop-up sprinkler has an internal diaphragm valve which is opened and closed by a solenoid or a hydraulically operated pilot valve. The diaphragm valve controls the entry of water into the outer case or housing of the sprinkler from a pressurized supply pipe or line to which it is connected. In many cases during the life of a so-called "valve-in-head" sprinkler the diaphragm valve will fail, often due to debris damaging the diaphragm valve seat or clogging the small passages in the diaphragm valve. The thin flexible diaphragm may also wear out. It is then necessary to shut off the water supply and dig up the sprinkler so that the defective diaphragm valve components can be repaired, or the sprinkler replaced in its entirety. This is a relatively expensive, tedious and time consuming process. Excavation of the defective sprinkler can also cause considerable damage to the surrounding landscaping.

U.S. Pat. No. 5,871,156 of Lawson assigned to Anthony Manufacturing Corporation discloses an impact type pop-up sprinkler having a valve seat that is removable from the top of the sprinkler case, without disconnecting the case from the water supply. However, impact type sprinklers are noisy, inaccurate in terms of arc coverage, and prone to breakage. In addition, it is necessary to individually disassemble and reassemble the various components of the diaphragm valve in order to gain access to the valve seat which must be unscrewed from the outer case. This part-by-part disassembly and re-assembly can be a difficult task for landscape maintenance personnel who are often simply gardeners.

It would therefore be desirable to provide a pop-up sprinkler with a turbine driven rotor and a diaphragm valve assembly that could be more readily serviced from the top of the sprinkler without having to dig up or otherwise disconnect the sprinkler from its supply line.

SUMMARY OF THE INVENTION

According to the present invention a self-camming snap ring is provided for removably securing a diaphragm valve module inside of a top serviceable pop-up sprinkler. The sprinkler includes an outer housing having an inlet at a lower end thereof. A riser is mounted inside the outer housing for vertical reciprocation through an opening in an upper end of the outer housing. A nozzle is mounted in an upper end of the riser for ejecting a stream of water. At least one valve actuator component is supported by the outer housing. The diaphragm valve module is mounted in the lower end of the outer housing for controlling the flow of water through the inlet in response to actuation of the valve actuator component. The diaphragm valve module is configured so that it is removable as a unit from the outer housing through the opening in the upper end of the outer housing upon removal of the riser from the outer housing. Thus, when the diaphragm valve fails, as is sometimes the case, the diaphragm valve module can be easily repaired or replaced after removing the riser, without having to dig up the sprinkler. The snap ring is mounted on top of the valve module. The snap ring is resilient and compressible and has a semi-circular shape including a pair of opposing peripheral annular portions. These annular portions can be disengaged from an annular groove formed in the interior wall of the outer housing by manually squeezing the annular portions together. The annular portions are formed with angled slots that receive pins that extend from the cover of the valve module to produce a camming movement that uniformly retracts the snap ring out of the annular groove to more readily permit removal of the valve module.

According to another aspect of the present invention, a snap ring is provided in the form of a semi-circular member made of a resilient flexible material. The member includes a pair of opposing peripheral annular portions that are radially retractable and expandable. Each opposing annular portion of the snap ring has a guide portion extending radially inwardly thereof. The guide portions of the snap ring have slots for receiving guide projections to control the radial retraction of the opposing annular portions to facilitate the withdrawal of the snap ring from a surrounding annular groove in an interior wall of an outer housing

DESCRIPTION OF THE PREFERRED EMBODIMENT

Figure 1:
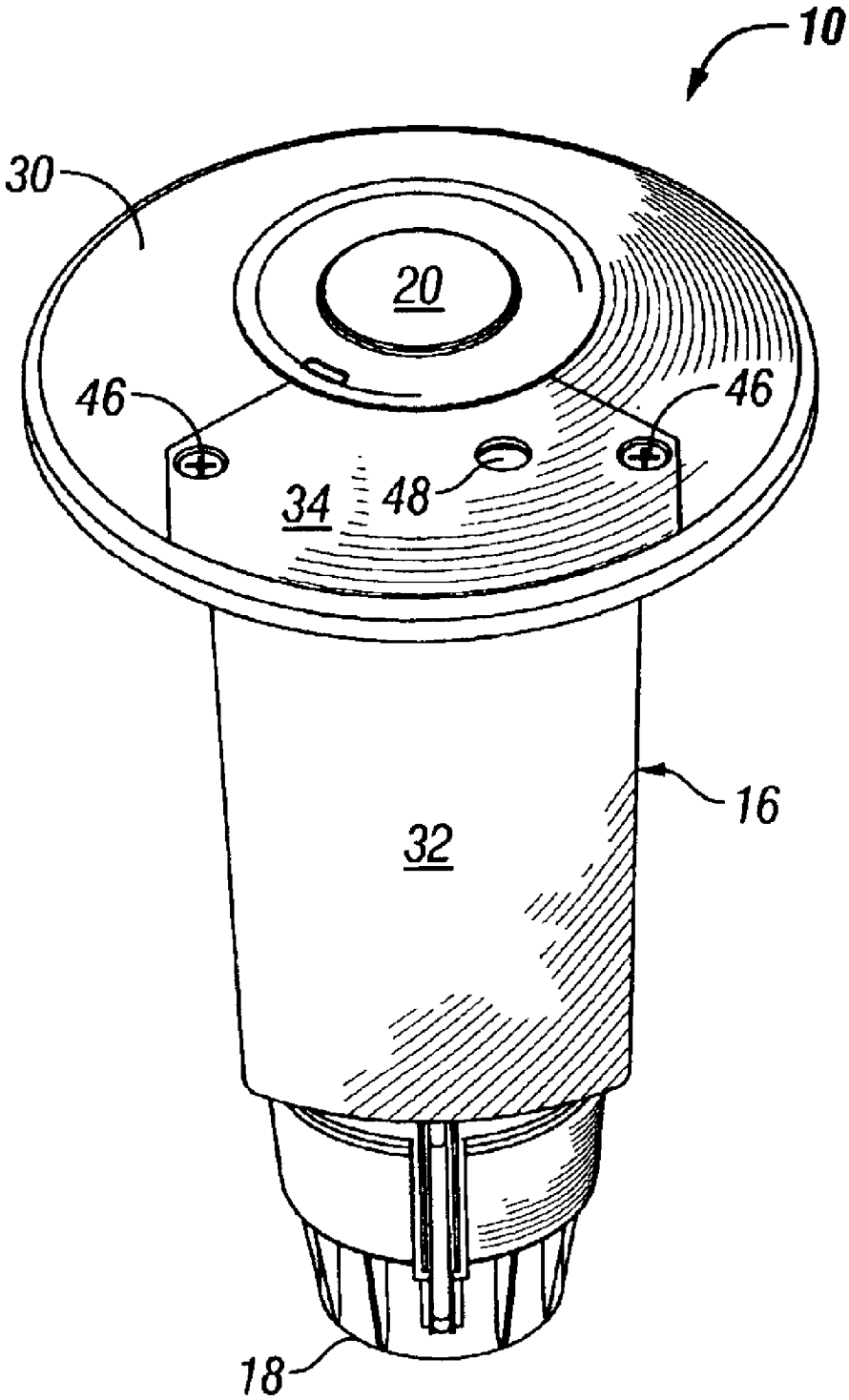
FIG. 1 is a perspective view of a pop-up sprinkler having a top serviceable valve module that incorporates a self-camming snap ring in accordance with a preferred embodiment of the present invention.
Figure 2:
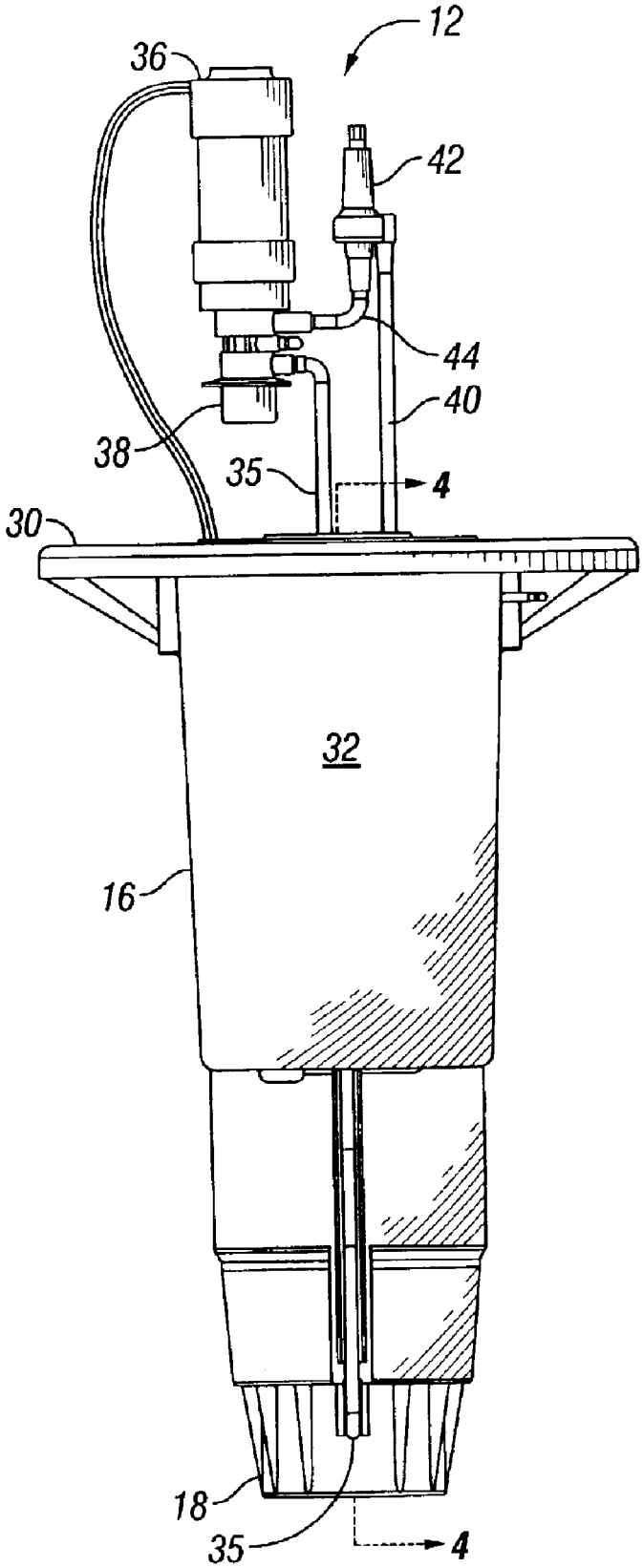
FIG. 2 is a side elevation view of the sprinkler of FIG. 1 showing its solenoid, pilot valve and pressure regulator pulled out of the top of the sprinkler.
Figure 4:
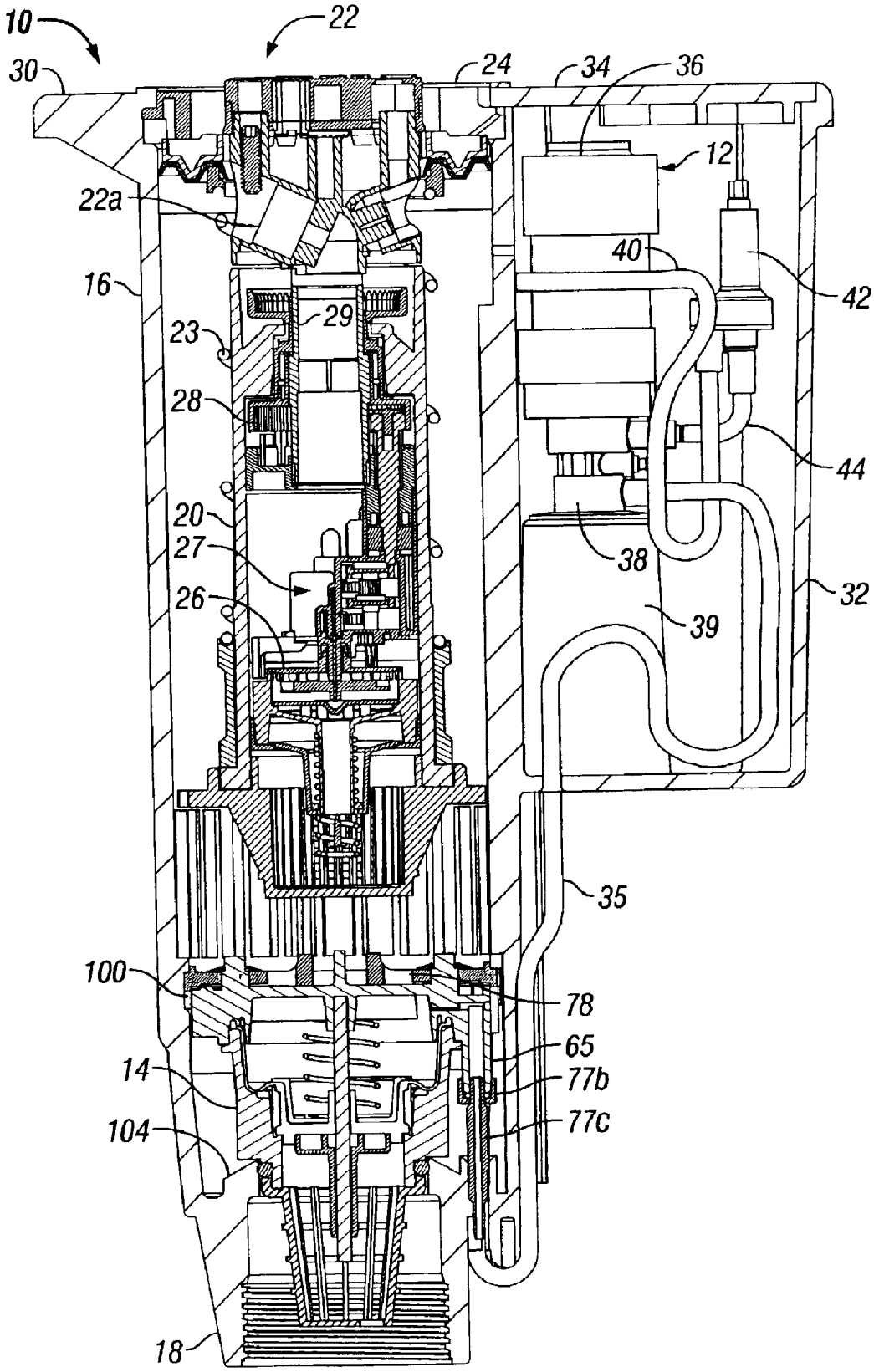
FIG. 4 is an enlarged vertical sectional view of the sprinkler of FIG. 1 taken along line 4—4 of FIG. 2.
Figure 5:
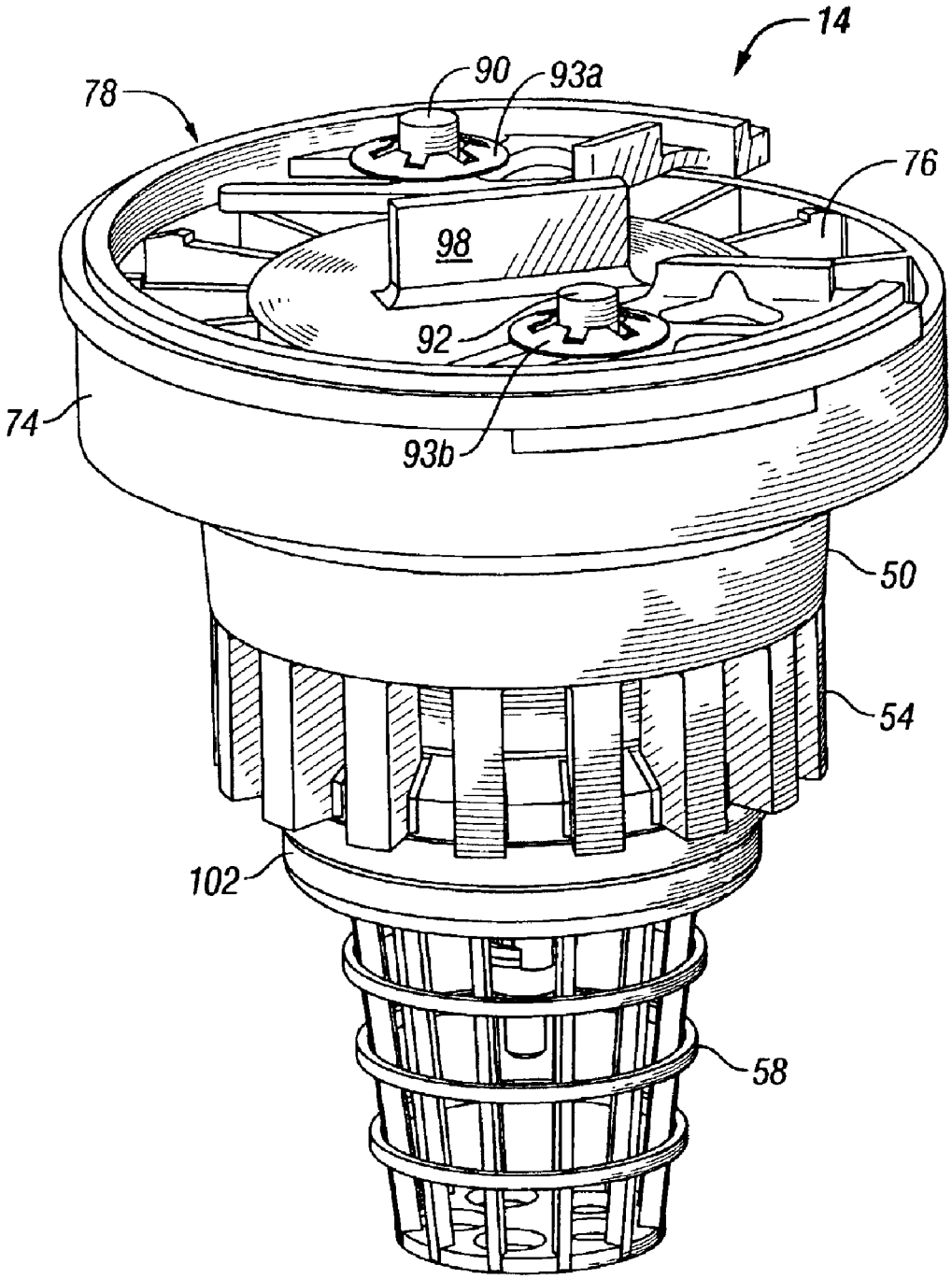
FIG. 5 is an enlarged perspective view of the diaphragm valve module of the sprinkler of FIGS. 1–4.

FIG. 1 illustrates a pop-up sprinkler 10 having a surface accessible valve actuator component assembly 12 (FIG. 2) and a top serviceable diaphragm valve module 14 (FIG. 5). Unless otherwise indicated, the parts of the sprinkler 10 are generally made of rigid molded plastic. The sprinkler 10 includes a vertically extending generally cylindrical hollow outer housing 16 (FIG. 1) having a female threaded inlet 18 at its lower end. As best seen in FIG. 4, the diaphragm valve module 14 is located in the lower end of the main housing 16 for admitting water through the inlet 18 into the interior of the housing 16. A tubular riser 20 is vertically reciprocable within the interior of the housing 16 when the housing 16 is connected to a source of pressurized water (not shown) and the diaphragm valve module 14 is opened and closed.

A cylindrical nozzle turret 22 (FIG. 4) including a conventional nozzle 22*a* is mounted at an upper end of the riser 20. The riser 20 is held in its retracted position by a riser retraction spring 23 that surrounds the riser 20 and is held in place by a split containment ring 24 snapped into a groove in the upper end of the housing 16. If desired, the containment ring 24 could be the co-molded type disclosed in U.S. Pat. No. 6,082,632, the entire disclosure of which is hereby incorporated by reference. The riser 20 also contains a water driven turbine 26 mounted within the riser 20 and coupled to the nozzle turret 22 through a gear train 27, an arc adjustment and reversing mechanism 28 and a drive shaft 29 for rotating the nozzle back and forth through an adjustable arc. Oscillating arc adjustable turbine driven nozzle rotating mechanisms are well known in the sprinkler art and need not be described herein in detail. See for example U.S. Pat. No. 5,720,435 of Richard E. Hunter, granted Feb. 24, 1998, the entire disclosure of which is hereby incorporated by reference. An impact drive spray head with a nozzle that is mounted on a vertically reciprocable riser could be used in place of the rotor type riser 20. See for example, U.S. Pat. No. 5,971,156 granted Feb. 16, 1999, the entire disclosure of which is hereby incorporated by reference.

Figure 3:
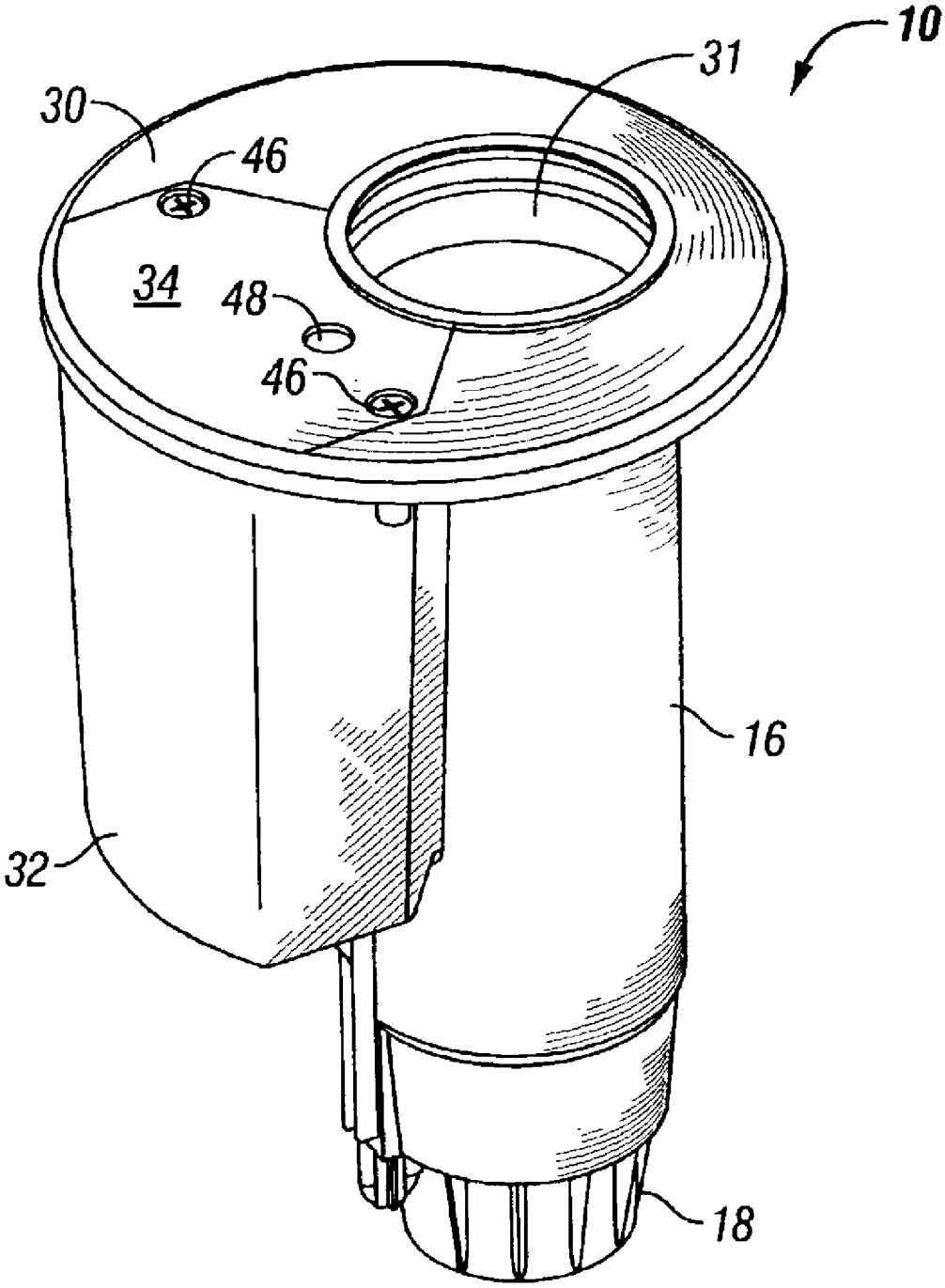
FIG. 3 is another perspective view of the sprinkler of FIG. 1, which has been rotated, illustrating the riser removed to show the opening in the upper end of its outer housing.

A circular ground support flange 30 (FIGS. 1–3) extends horizontally and radially outwardly from the upper end of the housing 16. The ground support flange 30 has an off-center riser opening 31 (FIG. 3) that communicates with the upper end of the housing 16 and through which the riser 20 extends. The opening 31 is also circular but it is eccentrically located with respect to the circular ground support flange 30. A generally rectangular valve actuator component assembly housing 32 (FIGS. 1–4) is connected to an exterior side of the housing 16. Preferably the housing 32 is integrally molded to the housing 16. The housing 32 has an openable lid 34 that aligns with, and effectively forms a part of, the ground support flange 30 when the lid 34 is in its closed position. Preferably the lid 34 does not extend beyond the periphery of the circular ground support flange 30. A groove for the split containment ring 24 extends along the upper end of the outer wall of the housing 32. It is desirable that the ground support flange 30 be circular and that the housing 32 not extend beyond the periphery of the flange 30. This allows maintenance personnel to cut a circular hole in turf with conventional equipment to accommodate the ground support flange 30.

As best seen in FIG. 4, the valve actuator component assembly 12 is mounted in the valve actuator component assembly housing 32. The assembly 12 is connectable via hose 35 to the diaphragm valve module 14 for opening and closing the diaphragm valve module 14. The valve actuator component assembly 12 includes a solenoid 36 and a pilot valve 38. The pilot valve 38 sits on a top of a shoulder or stand-off 39 molded into the bottom of the housing 32. Preferably the pilot valve 38 is locked to the stand-off 39 via a bayonet locking mechanism not fully visible in FIG. 4. A hose 40 connects to a vent fitting (not visible) on the side of the housing 16 and to a first side of an adjustable pressure regulator 42. Another hose 44 connects a second side of the pressure regulator 42 to the pilot valve 38. The critical parts 36, 38 and 42 of the valve actuator component assembly 12 are readily accessible from above a surface of a bed of soil (not illustrated) in which the housing 16 is planted upon moving the lid 34 to an open position. The lid 34 is removable entirely from the sprinkler 10 by removing screws 46 (FIG. 3) that are screwed into bores in the housing 32. Yardage numerals for a golf fairway may be engraved into the lid 34. Alternatively, the lid 34 can be molded with different yardage numerals thereon. A hole 48 in the lid 34 allows a tool (not shown) to be inserted into the housing 32 to engage the valve actuator component assembly 12 to manually switch the diaphragm valve module 14 to its ON, AUTOMATIC and OFF states.

Figure 6A:
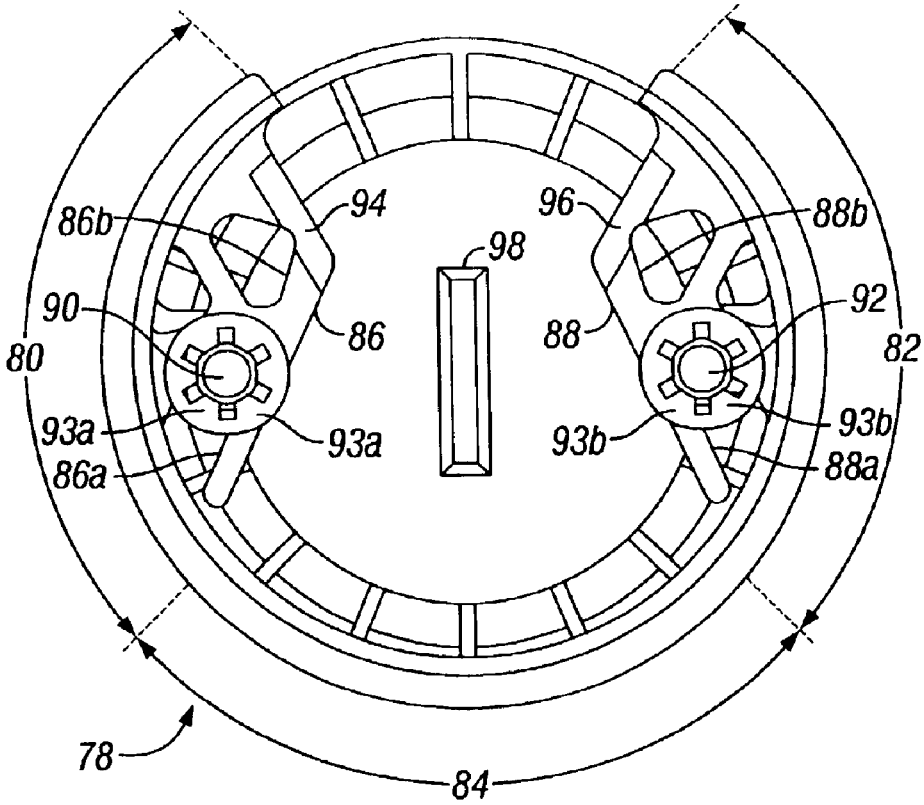
FIG. 6A is a top plan view of the diaphragm valve module of FIG. 5 illustrating the self-camming snap ring in its fully expanded state.
Figure 6B:
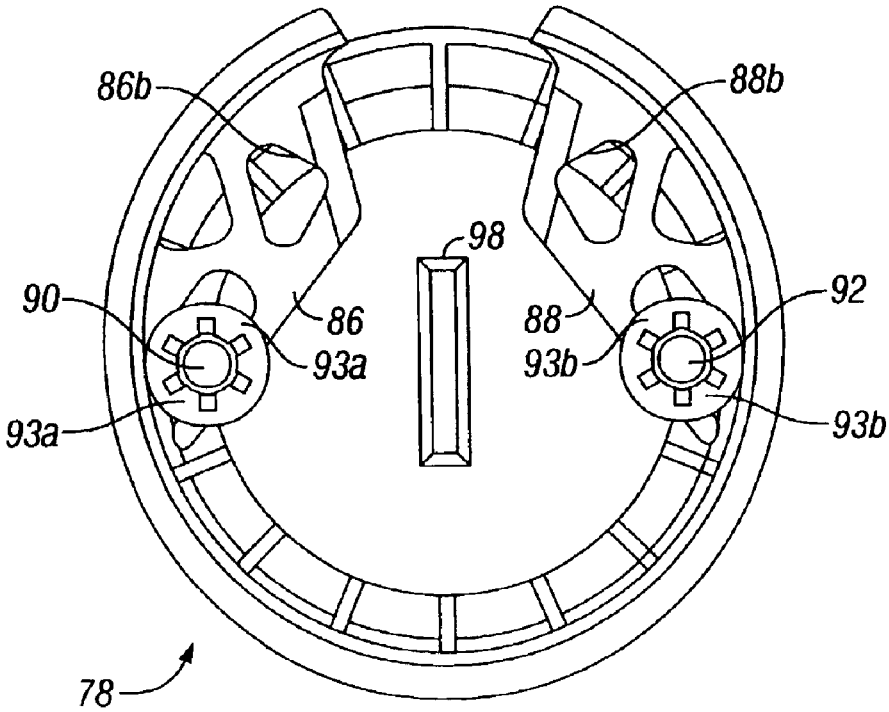
FIG. 6B is a top plan view of the diaphragm valve module of FIG. 5 illustrating the self-camming snap ring in its fully contracted state.
Figure 7:
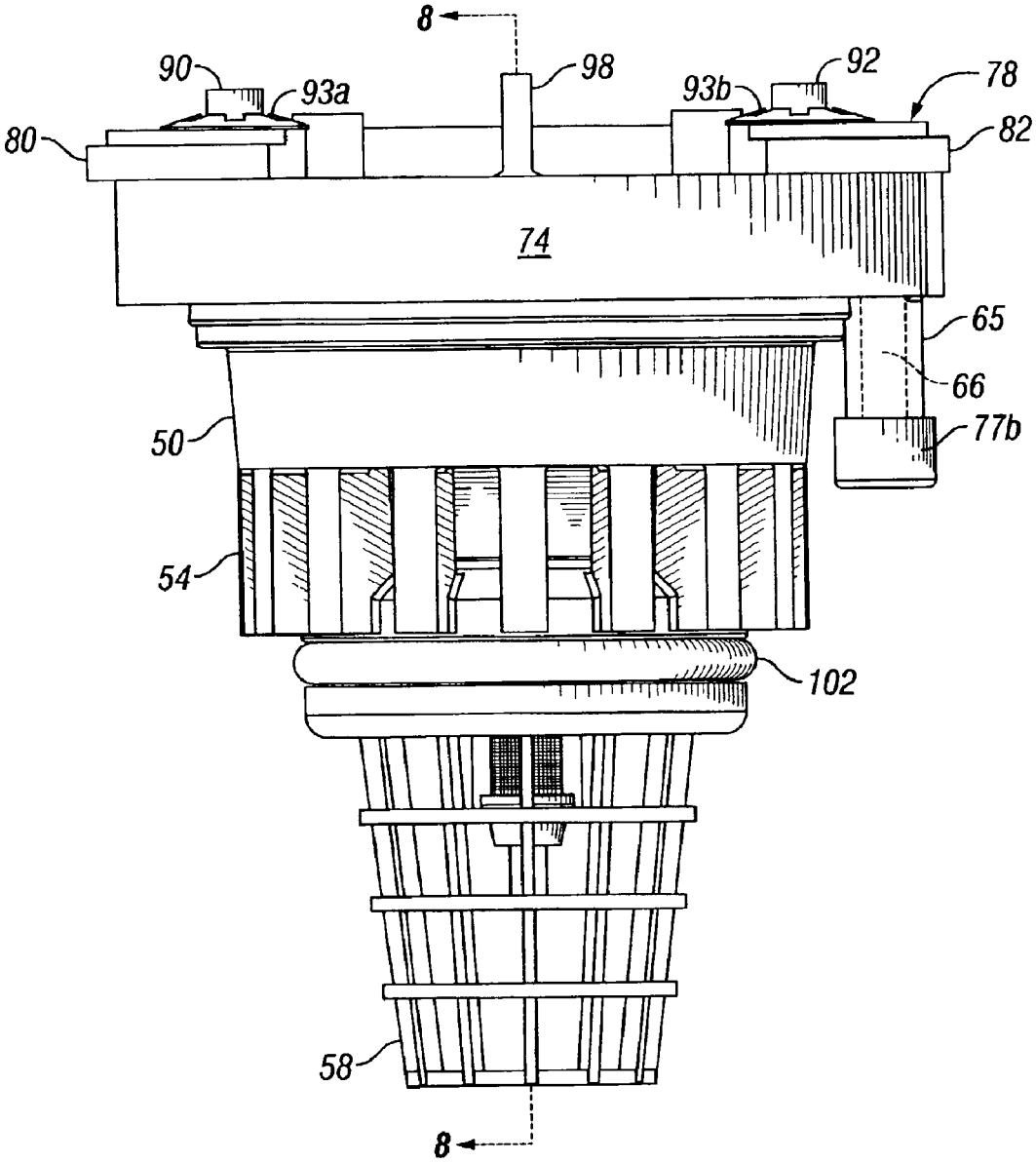
FIG. 7 is a side elevation view of the diaphragm valve module of FIG. 5.
Figure 8:
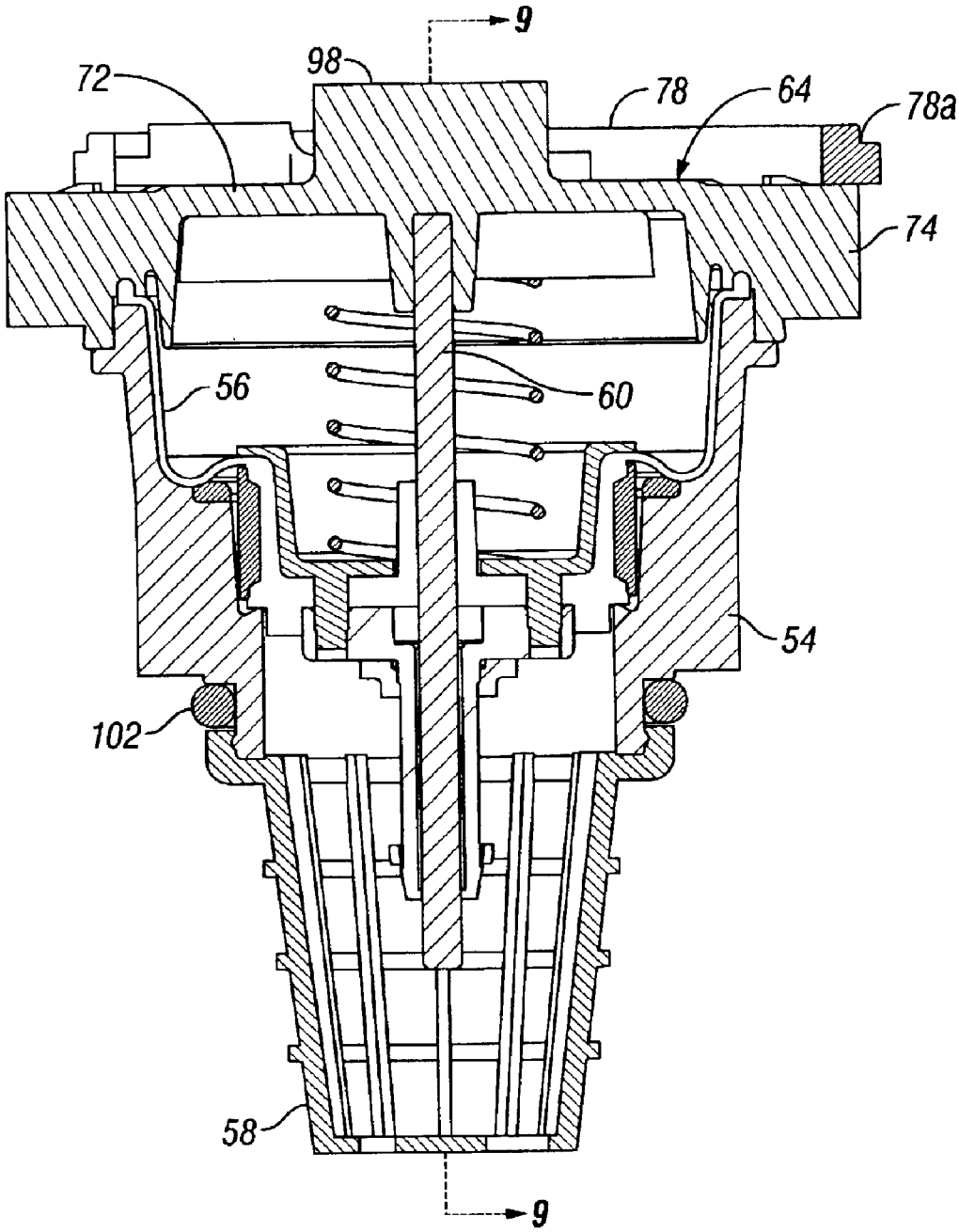
FIG. 8 is a vertical sectional view of the diaphragm valve module taken along line 8—8 of FIG. 7.

Referring to FIGS. 5–10, the diaphragm valve module 14 is specially configured for removal as a unit from the pop-up sprinkler 10 through the riser opening 31. The diaphragm valve module 14 includes a cylindrical valve body 50 (FIG. 7) and a generally cylindrical valve seat 52 (FIG. 9) connected to the valve body 50 by a plurality of axially extending, circumferentially spaced ribs 54 (FIG. 7). An elastomeric cylindrical valve member 56 (FIG. 9) is supported by the valve body 50. The valve member 56 is preferably made of a pliant transparent plastic material. The valve member 56 has a portion that engages and disengages the valve seat 52 to permit water to flow through the ribs 54 and around the valve body 50. A conical filter screen 58 is connected to the underside of the valve seat 52 for prevent large debris from contacting a metal metering pin 60 (FIGS. 8 and 9) that extends through a metering plate assembly made of upper and lower parts 62*a* and 62*b* (FIG. 9) that sandwich the lower central flat portion of the valve member 56. A cover 64 fits over the upper end of the valve body 50 and includes a hollow stem 65 with a pilot valve passage 66. The upper end of the metering pin 60 seats in a socket 68 formed in the underside of the cover 64. A coil spring 70 is compressed between the upper metering plate part 62*a* and the underside of the cover 64. The valve member 56 is of the rolling diaphragm type which deforms to disengage the valve seat 52 and permit the passage of water through the inlet 18 to the riser 20. This occurs when the pilot valve 38 is actuated by the solenoid 36 to vent pressure from the backside (upper side) of the valve member 56 via hose 35 and pilot valve passage 66. The cover 64 has a central portion 72 (FIG. 8), an outer annular portion 74 (FIG. 5) and a plurality of radially extending, circumferentially extending fins 76 (FIG. 10) that connect the central portion 72 of the cover 64 to the outer annular portion 74 defining water flow passages therebetween. The lower end of the stem 65 is provided with an elastomeric O-ring 77*a* (FIG. 9) that is retained by a cap 77*b*.

When the valve module 14 is inserted into its operative position in the lower end of the outer housing 16 as illustrated in FIG. 4, the valve module 14 is operatively connected to the valve actuator component assembly 12. More particularly, the tapered upper end of another hollow stem 77*c* enters the cap 77*b*. An air-tight seal is then made between the lower end of the stem 65 and the upper end of the stem 77*c* by means of the O-ring 77*a*. The hose 35 from the pilot valve 38 of the valve actuator component assembly 12 is permanently connected to the lower end of the stem 77*c*.

Figure 9:
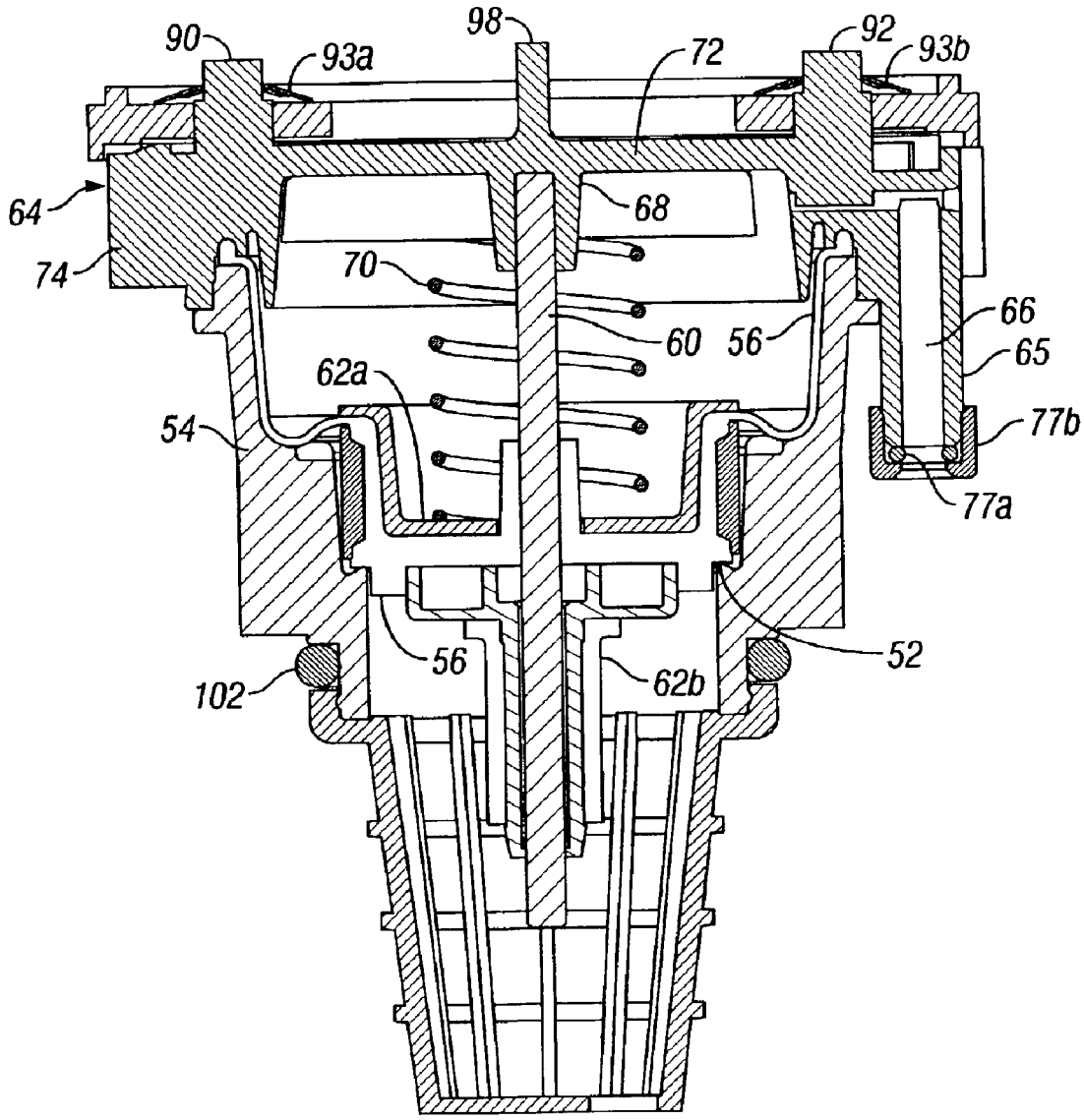
FIG. 9 is a vertical sectional view of the diaphragm valve module taken along line 9—9 of FIG. 8.
Figure 10:
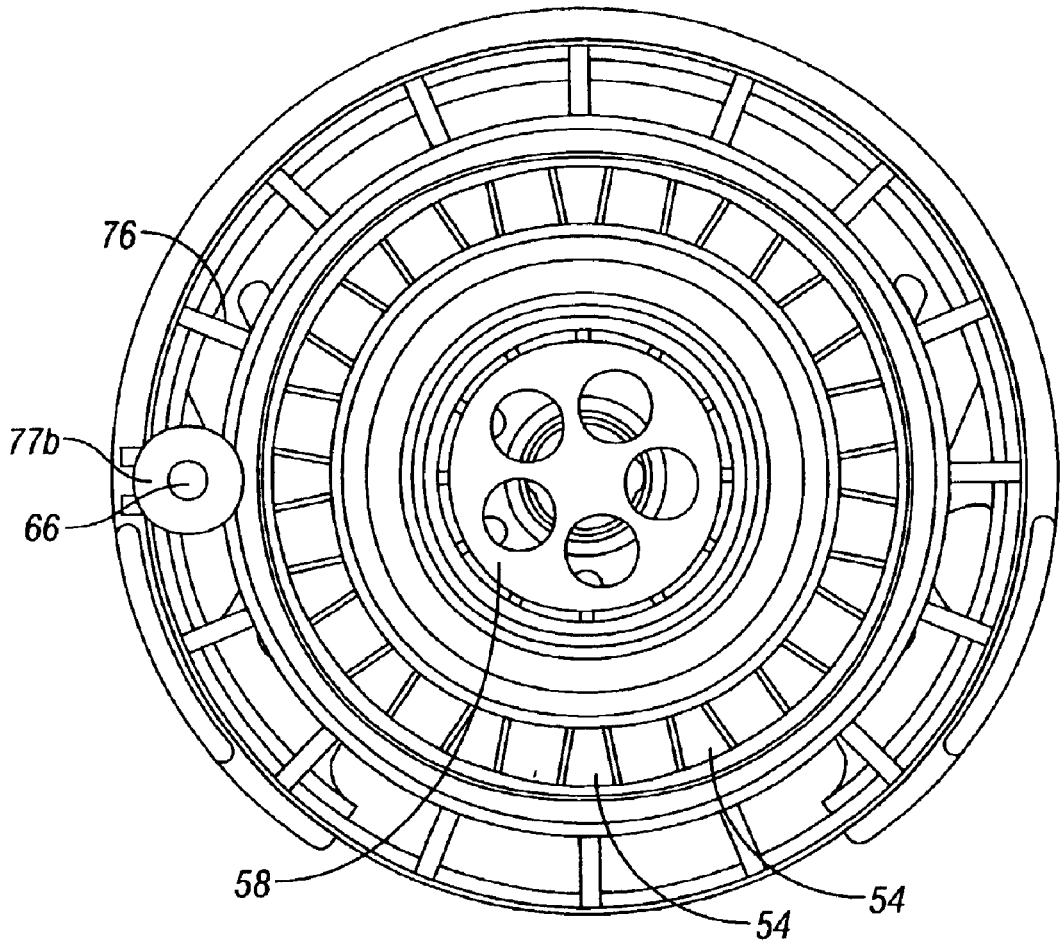
FIG. 10 is a bottom plan view of the diaphragm valve module of FIG. 5.
Figure 11:
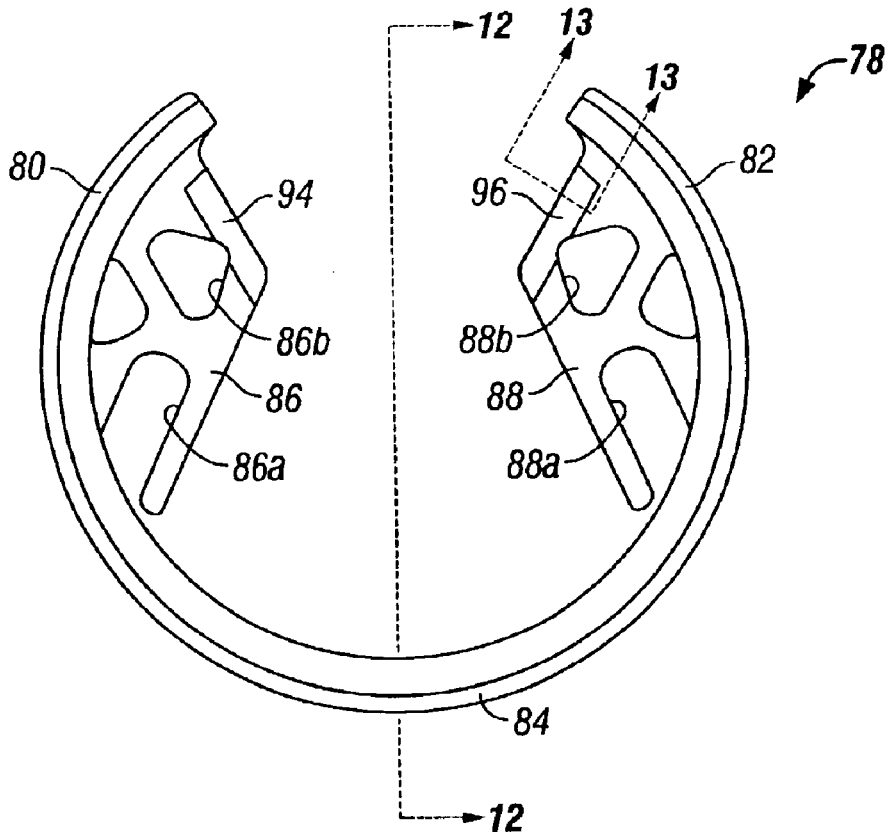
FIG. 11 is an enlarged top plan view of the snap ring of the diaphragm valve module of FIG. 5.
Figure 12:
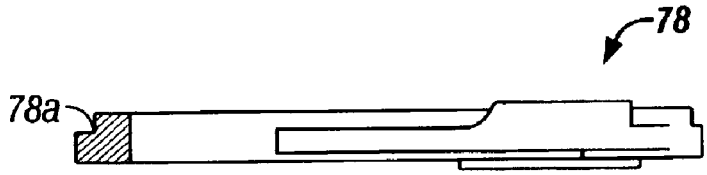
FIG. 12 is a section view of the snap ring taken along line 12—12 of FIG. 11.
Figure 13:
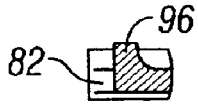
FIG. 13 is a section view of the snap ring taken along line 13—13 of FIG. 11.
Figure 14:
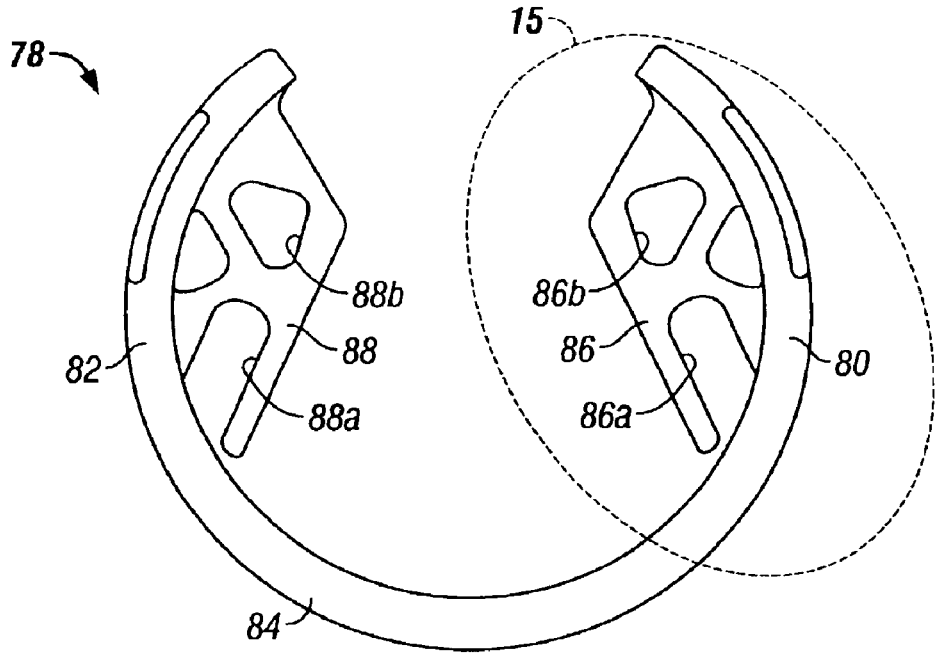
FIG. 14 is a bottom plan view of the snap ring.
Figure 15:
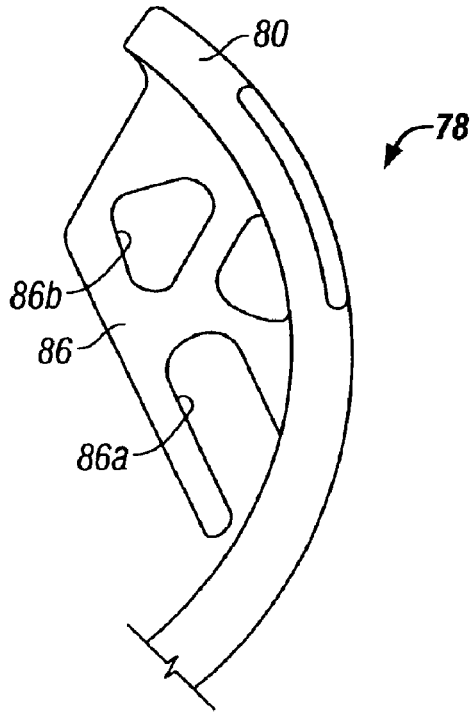
FIG. 15 is a further enlarged fragmentary view of the portion of the snap ring located with in the phantom line oval in FIG. 14.

A radially retractable and expandable snap ring 78 (FIG. 11) is mounted to the cover 64 (FIG. 8) for releasably holding the diaphragm valve module 14 in its operative position in the lower end of the outer housing 16 as illustrated in FIG. 4. The snap ring 78 has a generally semi-circular configuration that includes a pair of opposing peripheral annular portions 80 and 82 (FIG. 11) that are joined by a circular intermediate portion 84. The portions 80, 82 and 84 each comprise approximately one-third of the circumference of the semi-circular snap ring 78. The entire snap ring 78, and particularly the intermediate portion 84, are resilient and deformable so that it can be squeezed to radially retract the annular portions 80 and 82 toward each other. The peripheral annular portions 80 and 82 include guide portions 86 and 88, respectively, having slots 86*a* and 88*a*. The guide portions 86 and 88 of the snap ring 78 are generally planar and extend between the opposing annular portions 80 and 82 of the snap ring 78. The guide portions 86 and 88 have vertically extending tab portions 94 and 96, respectively. Each of the slots 86*a* and 88*a* slidingly receives a corresponding projection 90 and 92 (FIG. 9). The projections 90 and 92 are preferably integrally molded projections that extend from the top side of the cover 64. Alternatively, the projections 90 and 92 could be metal pins, screws or rivets, or any other suitable fastener.

With the riser 20 removed from the outer housing 16, a pair of needle nose pliers can be inserted into apertures 86*b* and 88*b* (FIG. 11) to thereby pull the peripheral annular portions 80 and 82 out of an annular groove 100 (FIG. 4) formed in the interior wall of the outer housing 16 of the sprinkler 10. A flange 98 (FIGS. 5, 8 and 9) extends vertically from the top center of the cover 64 and can be grasped between the thumb and index finger. The un-contracted and contracted configurations of the snap ring 78 are illustrated in FIGS. 6A and 6B, respectively. The radial contraction of the snap ring 78 allows the valve module 14 to be lifted out of the housing 16 through the riser opening 31. During re-insertion of the valve module 14, the same pliers are used to squeeze the guide portions 86 and 88 together while the valve module 14 is placed in the lower end of the housing 16. The guide portions 86 and 88 are then released and the central portion 84 returns to its true circular shape due to its resilience, forcing the peripheral annular portions 80 and 82 into the surrounding groove 100 in the outer housing 16. This firmly anchors and holds the valve module 14 in position in the lower end of the sprinkler 10. Clearly the maximum outer dimension of the diaphragm valve module 14 must be less than the smallest inner dimension of the central bore of the outer cylindrical housing 16 of the sprinkler 10 to permit insertion and withdrawal of the diaphragm valve module 14. Alternately, instead of the tool being inserted in to the apertures 86*b* and 88*b*, the tool could grip flanges, shoulders or other appropriate projections molded into the guide portions 86 and 88.

Another elastomeric O-ring 102 (FIGS. 7 and 8) surrounds the outside of the valve seat 52 and engages an interior surface of a shoulder 104 (FIG. 4) of the lower end of the cylindrical outer housing 16. The O-ring 102 provides a watertight seal between the diaphragm valve module 14 and the housing 16 at the female threaded inlet 18.

FIGS. 11–15 illustrate further details of the construction of the snap ring 78. The snap ring 78 has a stepped outer wall 78*a* visible in FIG. 12.

Thus, to recapitulate, the diaphragm valve module 14 includes a radially retractable and expandable snap ring 78. The snap ring 78 is made of a resilient flexible semi-circular member. The snap ring 78 is mounted to the cover 64 of the valve module 14 for releaseably holding the diaphragm valve module 14 in its operative position in the lower end of the outer housing 16. The snap ring 78 includes the opposing annular portions 80 and 82 that fit within the annular groove 100 in the interior wall of the outer housing 16 when the snap ring 78 is in an expanded condition. The opposing annular portions 80 and 82 of the snap ring 78 have guide portions 86 and 88, respectively, that extend radially inwardly thereof. The cover 64 of the diaphragm valve module 14 and the guide portions 86 and 88 of the snap ring 78 have cooperating projections 90 and 92 that ride in slots 86*a* and 88*a* of the snap ring 78 in order to control the radial retraction of the opposing annular portions 80 and 82. The slots 86*a* and 88*a* have arcuate-shaped ends. The projections 90 and 92 have a round cross-section and jawed metal retainer rings 93*a* and 93*b* (FIGS. 6A and 6B) snugly grip the upper ends of the projections 90 and 92 to prevent the snap ring 78 from detaching from the cover 64.

The slots 86*a* and 88*a* are angled to facilitate a self-camming action that permits easy withdrawal of the snap ring 78 from the annular groove 100 in the interior wall of the outer housing 16. This permits the diaphragm valve module 14 to be removed from the outer housing 16 through the riser opening 31 in the upper end of the outer housing 16 upon removal of the riser 20 from the outer housing 16.

The snap ring 78 preferably extends over at least ninety percent of the groove 100 in the interior wall of the outer housing 16 when the snap ring 78 is positioned in the groove 100 for holding the diaphragm valve module 14 in its operative position. More preferably the snap ring 78 extends over at least ninety-five percent of the extension of the groove 100. The slots 86*a* and 88*a* are straight and extend at an angle relative to each other.

Thus the present invention provides a labor saving sprinkler that permits repairs to its valve actuator component assembly and its diaphragm valve module to be easily made without having to excavate the sprinkler 10. While a preferred embodiment of a pop-up sprinkler with a top serviceable diaphragm valve module has been described in detail, it will be understood by those skilled in the art that my invention may be modified in both arrangement and detail. For example, my invention may be used with sprinklers other than the pop-up type. My invention can also be adapted for use with impact drive spray heads. The configuration of the outer housing 16, valve actuator component assembly 12 and the diaphragm valve module 14 can be widely varied. Therefore the protection afforded my invention should only be limited in accordance with the scope of the following claims.

What is claimed is:

1. A top serviceable pop-up sprinkler, comprising:

an outer housing having an inlet at a lower end thereof;

a riser mounted inside the outer housing for vertical reciprocation through an opening in an upper end of the outer housing;

a nozzle mounted in an upper end of the riser for ejecting a stream of water;

at least one valve actuator component supported by the outer housing;

a diaphragm valve module mounted in the lower end of the outer housing and connectable to the valve actuator component for controlling the flow of water through the inlet in response to actuation of the valve actuator component, the diaphragm valve module being removable as a unit from the outer housing through the opening in the upper end of the outer housing upon removal of the riser from the outer housing; and the diaphragm valve module including a radially retractable and expandable snap ring made of a resilient flexible semi-circular member for releasably holding the diaphragm valve module in an operative position in the lower end of the outer housing, the snap ring being mounted to a cover of the valve module for holding the diaphragm valve module in an operative position in the lower end of the outer housing, the snap ring including a pair of opposing annular portions that fit within an annular groove in an interior wall of the outer housing when the snap ring is in an expanded condition, each opposing annular portion of the snap ring having a guide portion extending radially inwardly thereof, the cover of the diaphragm valve module having projections that ride in slots in the guide portions to control the radial retraction of the opposing annular portions to facilitate the withdrawal of the snap ring from the annular groove in the interior wall of the outer housing to thereby permit the diaphragm valve module to be removed from the outer housing through the opening in the upper end of the outer housing upon removal of the riser from the outer housing.

2. The sprinkler of claim 1 wherein the guide portions each have an aperture for engagement with a tool to radially retract the opposing annular portions.

3. The sprinkler of claim 1 wherein the projections are integrally formed with a top cover of the diaphragm valve module.

4. The sprinkler of claim 1 wherein the diaphragm valve module has a flange that extends vertically from a top center of a cover of the diaphragm valve module.

5. The sprinkler of claim 1 wherein the snap ring extends over at least ninety percent of the groove in the interior wall of the outer housing when the snap ring is positioned in the groove holding the diaphragm valve module in the operative position in the lower end of the outer housing.

6. The sprinkler of claim 1 wherein the slots are straight and extend at an angle relative to each other.

7. The sprinkler of claim 1 wherein the guide portions of the snap ring are generally planar and extend between the opposing annular portions of the snap ring.

8. The sprinkler of claim 1 wherein the snap ring is held to a cover of the diaphragm valve module via retainers that attach to a pair of ends of the projections.

9. The sprinkler of claim 1 wherein the projections are fasteners.

10. The sprinkler of claim 1 wherein the riser includes a turbine driven by water flowing through the riser, a gear train coupled to the turbine, and an arc adjustment and reversing mechanism connecting the gear train to a drive shaft connected to the nozzle.

11. A valve-in-head sprinkler, comprising:

an outer housing;

an inner riser vertically reciprocable in the outer housing;

a nozzle mounted to an upper end of the housing;

a turbine and gear reduction assembly mounted inside the housing that rotates the nozzle upon water flowing past the turbine; and a diaphragm valve module removably mounted in a lower end of the housing for controlling the flow of water from an inlet at the lower end of the outer housing to a lower end of the riser, including a radially retractable and expandable snap ring mounted to a cover of the module for removably securing the module in an operative position in the lower end of the outer housing when the snap ring is in an expanded configuration in which it is seated in a groove in an interior wall of the outer housing, the snap ring being made of a resilient flexible semi-circular member having a pair of opposing peripheral annular portions, and a pair of opposing guide portions with slots, each guide portion extending radially inwardly from a corresponding annular portion, and a pair of projections extending from a top cover of the module through corresponding ones of the slots, the projections being slidable in the slots and the slots being configured to control the radial expansion and contraction of the opposing annular portions, and a pair of apertures each formed in a corresponding one of the guide portions for engagement by a tool for manually contracting the opposing annular portions to remove the annular portions from the annular groove.

* * * * *